US005975923A

United States Patent [19]

Chen

[11] Patent Number: 5,975,923

[45] Date of Patent: Nov. 2, 1999

[54] ELECTRICAL APPLIANCE WITH A METAL PLATE FOR A GROUNDING DEVICE

[75] Inventor: Ryh-Shing Chen, Taipei, Taiwan

[73] Assignee: Sen-Wen Chen, Taipei, Taiwan

[21] Appl. No.: 08/934,709

[22] Filed: Sep. 22, 1997

[30] Foreign Application Priority Data

Oct. 29, 1996 [TW] Taiwan ..... 85216594

[51] Int. Cl.[6] ..... H01R 4/66

[52] U.S. Cl. ..... 439/95; 439/608

[58] Field of Search ..... 439/95, 97, 92, 439/96, 608

[56] References Cited

U.S. PATENT DOCUMENTS 4,720,155 1/1988 Schildkraut et al. ..... 439/608

*Primary Examiner*—Paula Bradley
*Assistant Examiner*—Alexander Gilman
*Attorney, Agent, or Firm*—Ladas & Parry

[57] ABSTRACT

An electrical appliance includes a conductive casing, a connector and a grounding device. The connector includes an insulator body mounted on the conductive casing, and a ground terminal disposed on the insulator body. The ground terminal has a connecting end that extends inwardly of the conductive casing. The grounding device includes a metal plate which has a first end mounted on the conductive casing, and a second end defining an engaging hole that engages the connecting end of the ground terminal.

2 Claims, 3 Drawing Sheets

ELECTRICAL APPLIANCE WITH A METAL PLATE FOR A GROUNDING DEVICE

BACKGROUND OF THE INVENTION

1. Field of the Invention

The invention relates to an electrical appliance, ore particularly to an electrical appliance with an improved grounding device.

2. Description of the Related Art

Referring to FIG. 1, a conventional electrical appliance 1, such as a power supply for a computer, includes a conductive casing 12, two connectors 13, 14 and a grounding device consisting of first and second grounding wires 15, 16. Each of the connectors 13, 14 includes an insulator body 130, 140 mounted on a side wall 11 of the conductive casing 12 and a ground terminal 131, 141 disposed on the insulator body 130, 140. Each ground terminal 131, 141 has a connecting end that extends inwardly of the conductive casing 12. Each of the first and second grounding wires 15, 16 has a first end 151, 161 soldered on a respective one of the connecting ends of the ground terminals 131, 141, and a second end 152, 162 mounted on a bottom of the conductive casing 12. The connectors 13, 14 further have four wires for connecting electrically a printed circuit board 17 of the electrical appliance thereto.

Note that, prior to the soldering process, the first ends 151, 161 of the grounding wires 15, 16 must be positioned by the use of other tools, such as a pair of pliers, in order to place the same on the connecting ends of the ground terminals 131, 141. This inconveniences the operator.

SUMMARY OF THE INVENTION

Therefore, the object of this invention is to provide an electrical appliance which has an improved grounding device that can be easily soldered to the ground terminal of the electrical appliance without the need for using positioning tools.

Accordingly, an electrical appliance of this invention includes a conductive casing, a connector, and a grounding device. The connector includes an insulator body mounted on the conductive casing, and a ground terminal disposed on the insulator body. The ground terminal has a connecting end that extends inwardly of the conductive casing. The grounding device includes a metal plate which has a first end mounted on the conductive casing, and a second end defining an engaging hole that engages the connecting end of the ground terminal.

Engagement of the second end of the metal plate with the connecting end of the ground terminal facilitates soldering therebetween.

BRIEF DESCRIPTION OF THE DRAWINGS

Other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
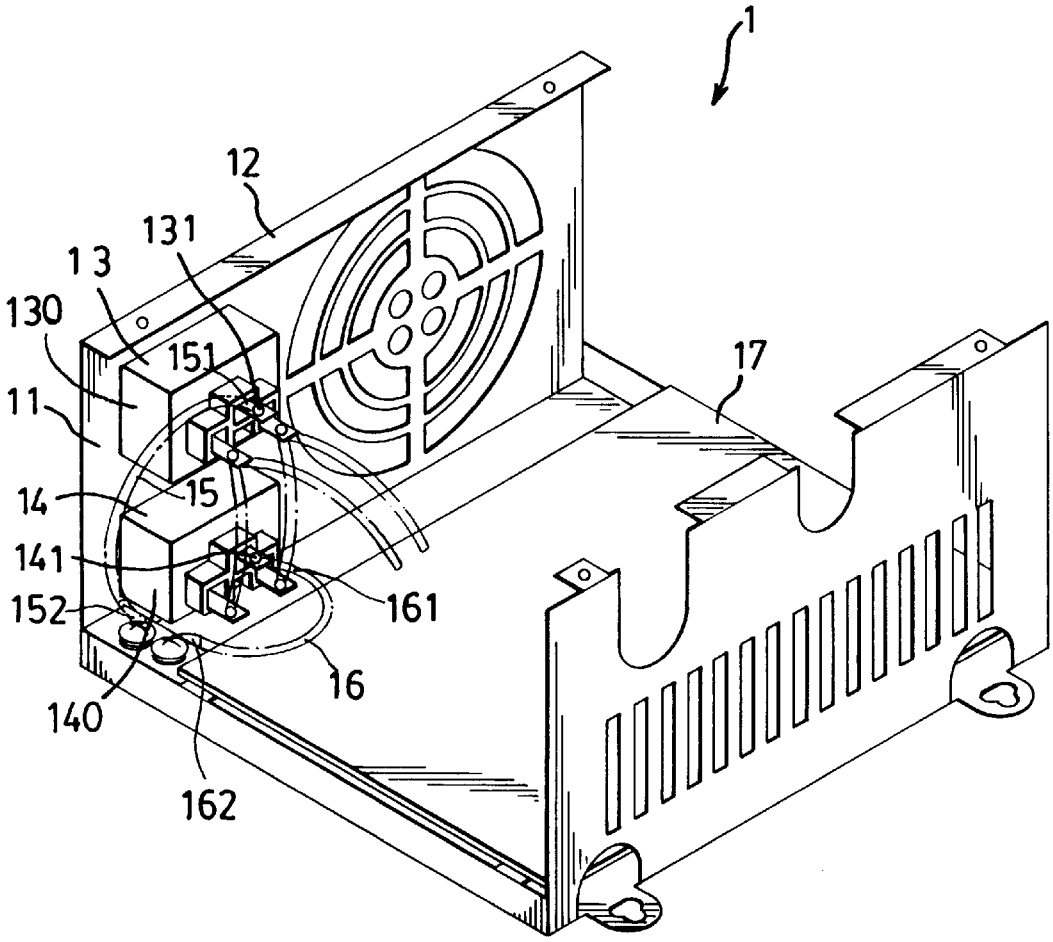
FIG. 1 PRIOR ART
FIG. 1 is a perspective view of a conventional electrical appliance.
Figure 2:
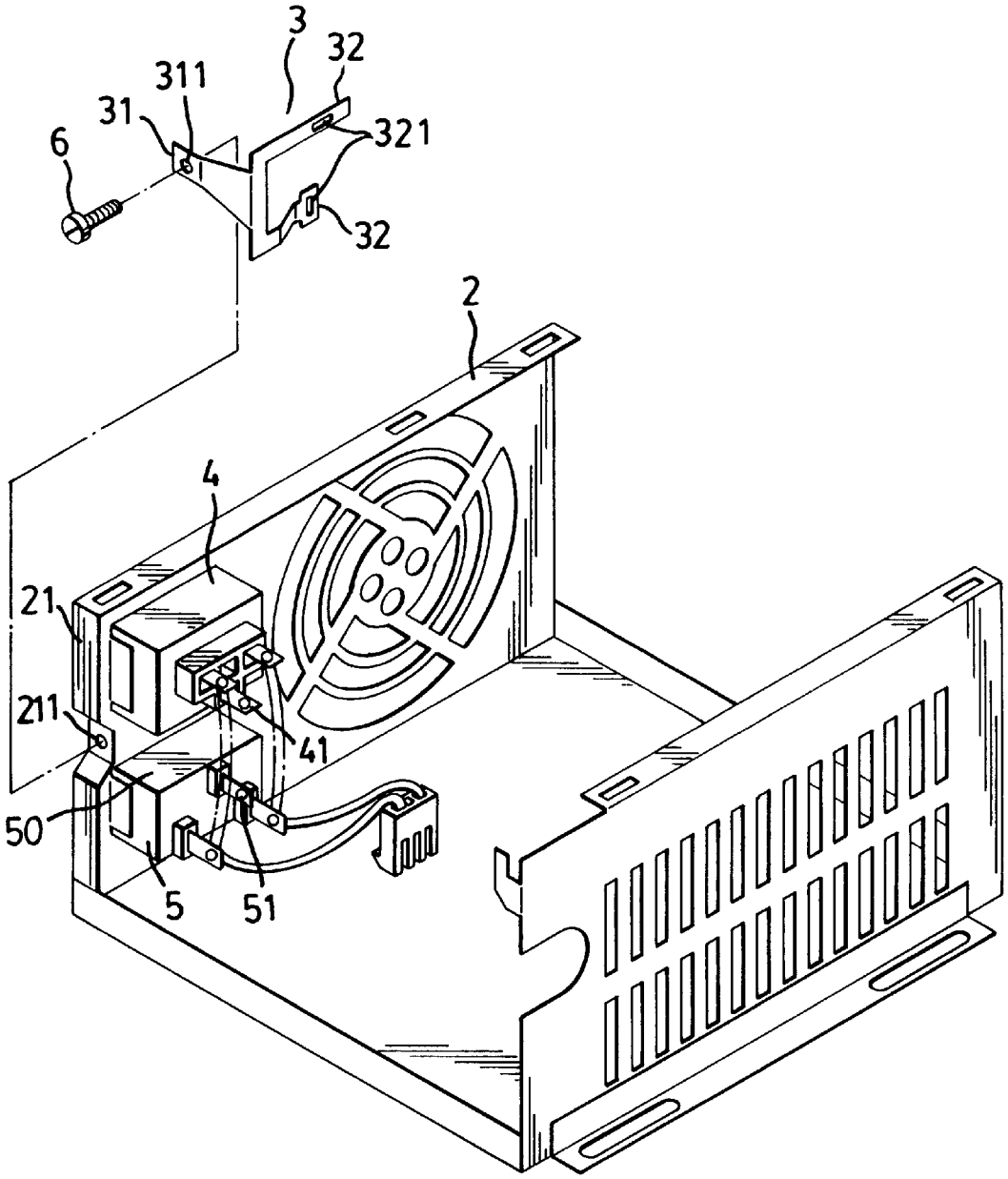
FIG. 2 is a perspective view of an electrical appliance of this invention, wherein the grounding device employed therein is removed for clarity.
Figure 3:
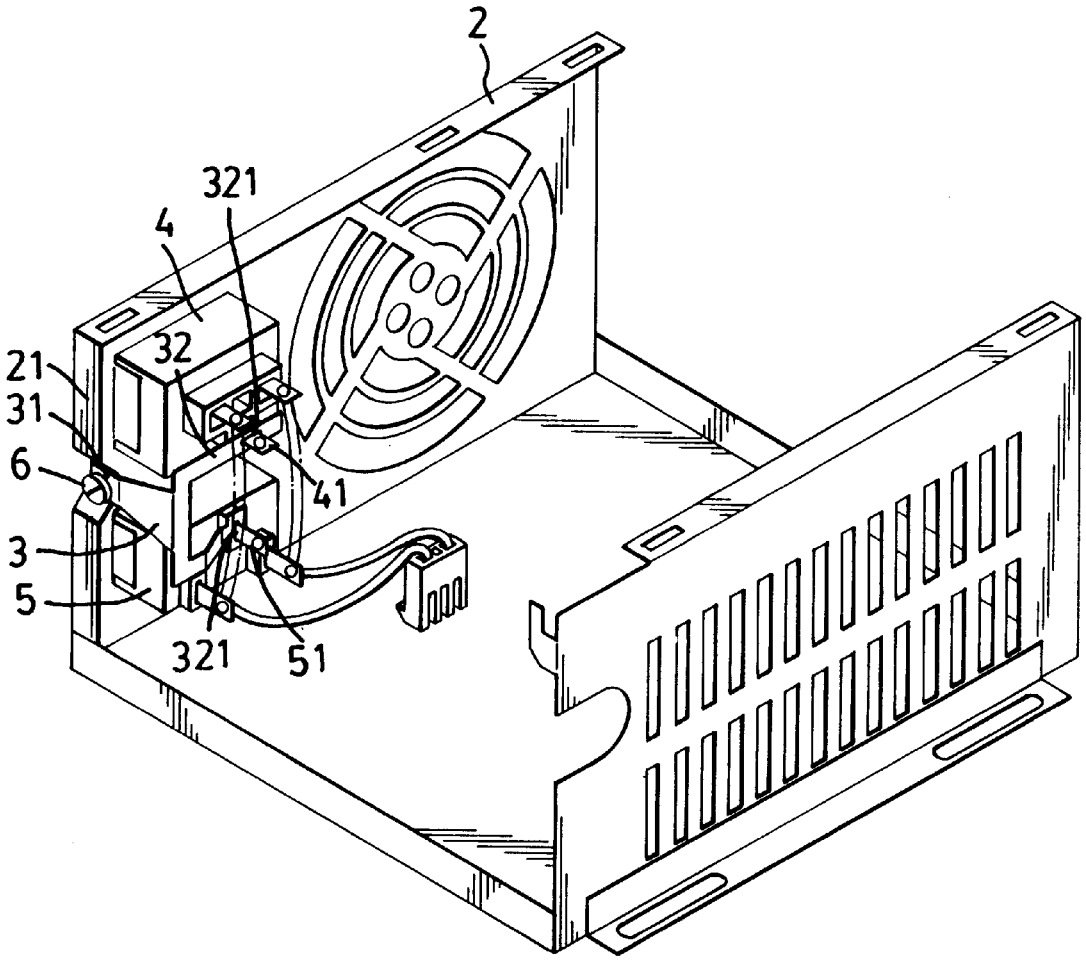
FIG. 3 is a perspective view of the electrical appliance of this invention.

Referring to FIGS. 2 and 3, the preferred embodiment of an electrical appliance of this invention is shown to include a conductive casing 2, two connectors 4, 5, and a grounding device 3.

As illustrated, each of the connectors 4, 5 includes an insulator body 40, 50 mounted on the conductive casing 2, and a ground terminal 41, 51 disposed on the insulator body 40, 50. Each of the ground terminals 41, 51 has a connecting end that extends inwardly of the conductive casing 2.

The grounding device 3 includes a metal plate which has a first end 31 mounted on the conductive casing 2 and two generally parallel second ends 32 that define two engaging holes 321 which permit extension of the connecting ends of the ground terminals 41, 51 therethrough. Thus, the second ends 32 of the metal plate can be soldered on the connecting ends of the ground terminals 41, 51 without using positioning tools.

In the preferred embodiment, the first end 31 of the metal plate forms an angle with the second ends 32 and is provided with a hole 311. The side wall 21 of the conductive casing 2 is formed with an engagement hole 211 such that a screw 6 can extend through the hole 311 of the metal plate for threading into the engagement hole 211.

With this invention thus explained, it is apparent that numerous modifications and variations can be made without departing from the scope and spirit of this invention. It is therefore intended that this invention be limited only as indicated in the appended claims.

I claim:

1. an electrical appliance comprising:

a conductive casing;

a connector including an insulator body mounted on said conductive casing, and a ground terminal disposed on said insulator body and having a connecting end which extends inwardly of said conductive casing; and a grounding device including a metal plate which has a first end mounted on said conductive casing so as to extend in a first plane, and a second end extending in a second plane transverse to said first planar plane and defining an engaging hole that engages said connecting end of said ground terminal.

2. An electrical appliance comprising:

a conductive casing wherein said conductive casing has an engagement hole and a screw for mounting said first end of said metal plate to said conductive casing at said engagement hole;

a connector including an insulator body mounted on said conductive casing, and a ground terminal disposed on said insulator body and having a connecting end which extends inwardly of said conductive casing; and a grounding device including a metal plate which has a first end mounted on said conductive casing, and a second end defining an engaging hole that engages said connecting end of said ground terminal.

* * * * *